US009759436B2

(12) United States Patent
Jinnai et al.

(10) Patent No.: US 9,759,436 B2
(45) Date of Patent: Sep. 12, 2017

(54) OUTDOOR UNIT FOR AN AIR-CONDITIONING APPARATUS COMPRISING FOLDING PIECES EXTENDING FROM THE BASE

(71) Applicant: Mitsubishi Electric Corporation, Tokyo (JP)

(72) Inventors: Hiroyuki Jinnai, Tokyo (JP); Toshiyuki Kubono, Tokyo (JP); Tomoya Yanase, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 56 days.

(21) Appl. No.: 14/683,339

(22) Filed: Apr. 10, 2015

(65) Prior Publication Data

US 2016/0033146 A1 Feb. 4, 2016

(30) Foreign Application Priority Data

Jul. 30, 2014 (JP) ..... 2014-155098

(51) Int. Cl.
*F25D 23/12* (2006.01)
*B21D 11/10* (2006.01)
(Continued)

(52) U.S. Cl.
CPC ..... *F24F 1/16* (2013.01); *F24F 1/22* (2013.01); *F24F 1/38* (2013.01); *F24F 1/60* (2013.01); *F24F 13/32* (2013.01)

(58) Field of Classification Search
CPC ..... F24F 1/16; F24F 1/22; F24F 1/38; F24F 1/60; F24F 13/32
(Continued)

(56) References Cited

U.S. PATENT DOCUMENTS 5,775,119 A * 7/1998 Yamada ..... F24F 1/06 312/100
5,870,868 A * 2/1999 Kita ..... E04C 2/384 312/140
(Continued)

FOREIGN PATENT DOCUMENTS

JP 08-128665 A 5/1996
JP H08-136006 A 5/1996
(Continued)

OTHER PUBLICATIONS

Machine Translation of Sugiyama, Mar. 6, 2004; Espacenet; 2004-156887; Outdoor Unit for an air conditioner; all.*
(Continued)

*Primary Examiner* — Allen Flanigan
*Assistant Examiner* — Filip Zec
(74) *Attorney, Agent, or Firm* — Posz Law Group, PLC

(57) ABSTRACT

The motor fixing support includes long base sections extending in a vertical direction, which are respectively formed on both sides in a lateral direction, and folding pieces respectively extending from both side edges of the respective base sections in a short-side direction. The length of the folding piece in the extending direction, which extends from the base section toward the base section in the short-side direction, and the length of the folding piece in the extending direction, which extends from the base section toward the base section in the short-side direction, are larger than the lengths of the folding pieces in the extending direction.

9 Claims, 5 Drawing Sheets

(51) Int. Cl.

| | |
|---|---|
| ***B21D 39/00*** | (2006.01) |
| ***B23P 11/00*** | (2006.01) |
| ***B23P 19/00*** | (2006.01) |
| ***F24F 1/16*** | (2011.01) |
| ***F24F 13/32*** | (2006.01) |
| ***F24F 1/38*** | (2011.01) |
| ***F24F 1/22*** | (2011.01) |
| ***F24F 1/60*** | (2011.01) |

(58) Field of Classification Search
USPC ..... 29/513, 732; 72/379.4
See application file for complete search history.

(56) References Cited

U.S. PATENT DOCUMENTS 7,275,389 B2 * 10/2007 Bae ..... F24F 1/0007 62/419
7,918,101 B2 * 4/2011 Sugiyama ..... F24F 1/56 62/259.1

FOREIGN PATENT DOCUMENTS

| | | | |
|---|---|---|---|
| JP | 11-023009 | A | 1/1999 |
| JP | 3071922 | U | 7/2000 |
| JP | 2004-156887 | A | 6/2004 |
| JP | 2011-106758 | A | 6/2011 |
| JP | 2013-231553 | A | 11/2013 |

OTHER PUBLICATIONS

Extended European Search Report issued Feb. 5, 2016 in the corresponding EP application No. 15164922.5.
Office Action mailed Mar. 28, 2017 issued in corresponding JP patent application No. 2014-155098 (and English Translation).

* cited by examiner

OUTDOOR UNIT FOR AN AIR-CONDITIONING APPARATUS COMPRISING FOLDING PIECES EXTENDING FROM THE BASE

TECHNICAL FIELD

The present invention relates to an outdoor unit for an air-conditioning apparatus.

BACKGROUND ART

Hitherto, an air-conditioning apparatus including a motor fixing support, which is configured to fix a drive motor for driving a fan, has been known (see, for example, Patent Literature 1).

In the air-conditioning apparatus disclosed in Patent Literature 1, in order to prevent occurrence of product defects such as deformation of the motor fixing support due to weight of the fan and the motor during transportation of an outdoor unit, U-shaped strength-reinforcement plates are fixed to the motor fixing support with screws. In this manner, a required strength of the motor fixing support is ensured.

CITATION LIST

Patent Literature

Patent Literature 1: Japanese Unexamined Patent Application Publication No. H8-128665 (Page 2, FIG. 1)

SUMMARY OF INVENTION

Technical Problems

However, in the air-conditioning apparatus disclosed in Patent Literature 1, the motor fixing support and the strength-reinforcement plates are formed as separate members, and hence fixing members such as the screws are required as described above. Therefore, there is a problem in that the number of components is increased. Further, there is a problem in that, due to the increase in number of components, the number of steps of mounting work is increased, and a usage amount of materials is increased.

The present invention has been made in view of the problems described above, and it is therefore an object of the present invention to provide an outdoor unit for an air-conditioning apparatus, which is capable of reducing a usage amount of materials and reinforcing the strength of a motor fixing support without increasing the number of components.

Solution to Problems

According to one embodiment of the present invention, there is provided an outdoor unit for an air-conditioning apparatus, including: a housing; an outdoor heat exchanger arranged inside the housing; a fan arranged on a front surface of the outdoor heat exchanger; a motor configured to drive the fan; and a motor fixing support configured to fix the motor, the motor fixing support including: long base sections extending in a vertical direction and respectively formed on both sides of the motor fixing support in a lateral direction; and folding pieces respectively extending from both side edges of each of the base sections in a short-side direction, one of the folding pieces extending from one of the base sections toward an other of the base sections, an other of the folding pieces extending from the other of the base sections toward the one of the base sections, the one and the other of the folding pieces having lengths in respective extending directions larger than a length in an extending direction of still other at least one of the folding pieces, wherein, under a folded state, the folding pieces respectively extending from both the side edges of the each of the base sections in the short-side direction, extend toward a front surface side of the housing or a rear surface side of the housing.

Advantageous Effects of Invention

According to the one embodiment of the present invention, the folding pieces for reinforcing the strength of the motor fixing support are each formed as one element of the motor fixing support, and hence the usage amount of materials can be reduced and the strength of the motor fixing support can be reinforced without increasing the number of components. Further, the length of the folding piece in the extending direction, which extends from one base section toward the other base section in the short-side direction, and the length of the folding piece in the extending direction, which extends from the other base section toward the one base section in the short-side direction, are larger than the lengths of the still other folding pieces in the extending direction, and hence the usage amount of materials can be reduced.

DESCRIPTION OF EMBODIMENTS

An outdoor unit 100 for an air-conditioning apparatus according to the present invention is described in detail with reference to the drawings. Note that, the relationships between the sizes of components in the following drawings may be different from the actual relationships. Further, in the following drawings, components denoted by the same reference symbols correspond to the same or equivalent components. This is common throughout the description herein. In addition, the forms of the components described herein are merely examples, and the components are not limited to the description herein.

Embodiment 1

Figure 1:
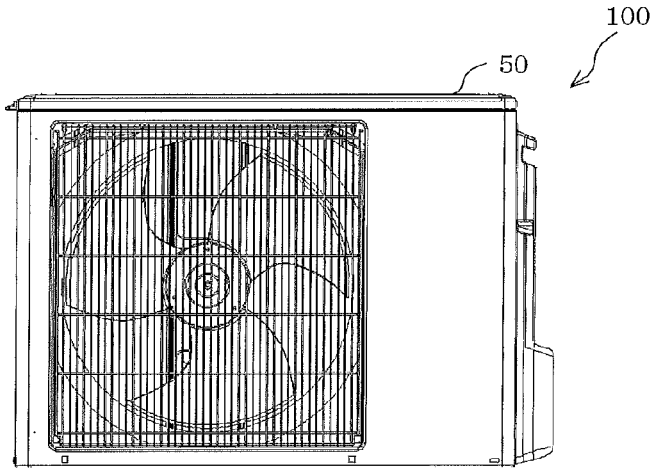
FIG. 1 is a front view of an outdoor unit 100 for an air-conditioning apparatus according to Embodiment 1 of the present invention.
Figure 2:
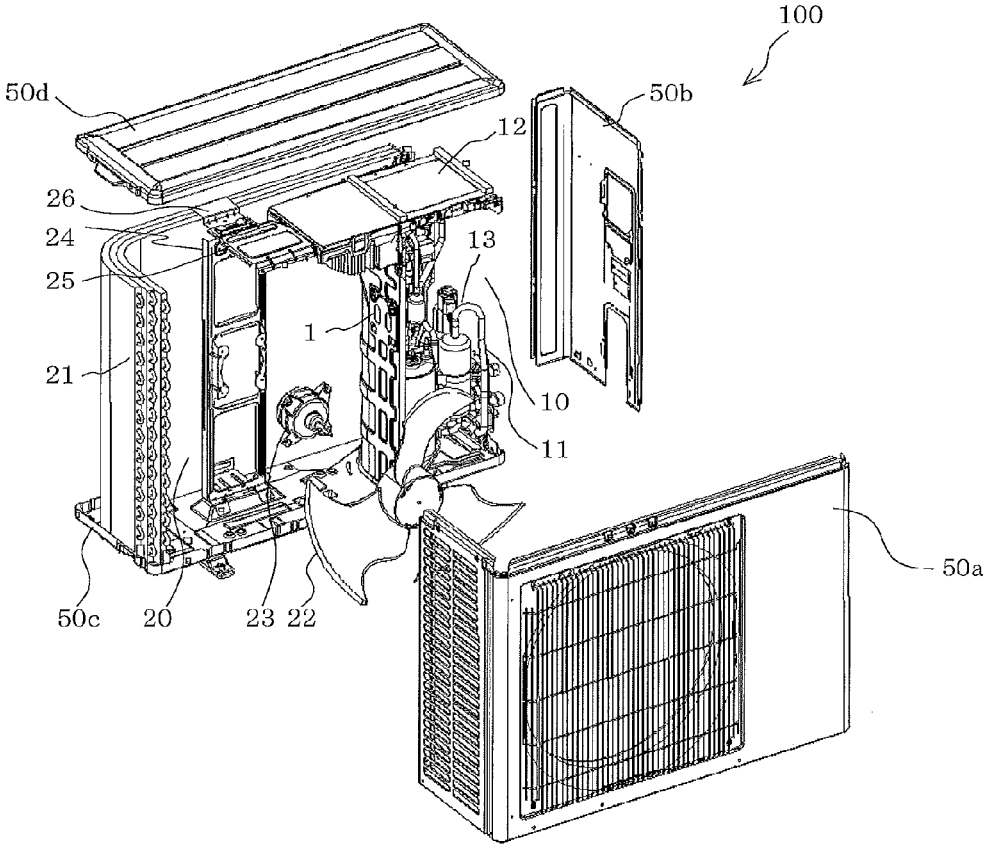
FIG. 2 is an exploded perspective view of the outdoor unit 100 for an air-conditioning apparatus according to Embodiment 1 of the present invention.
Figure 3:
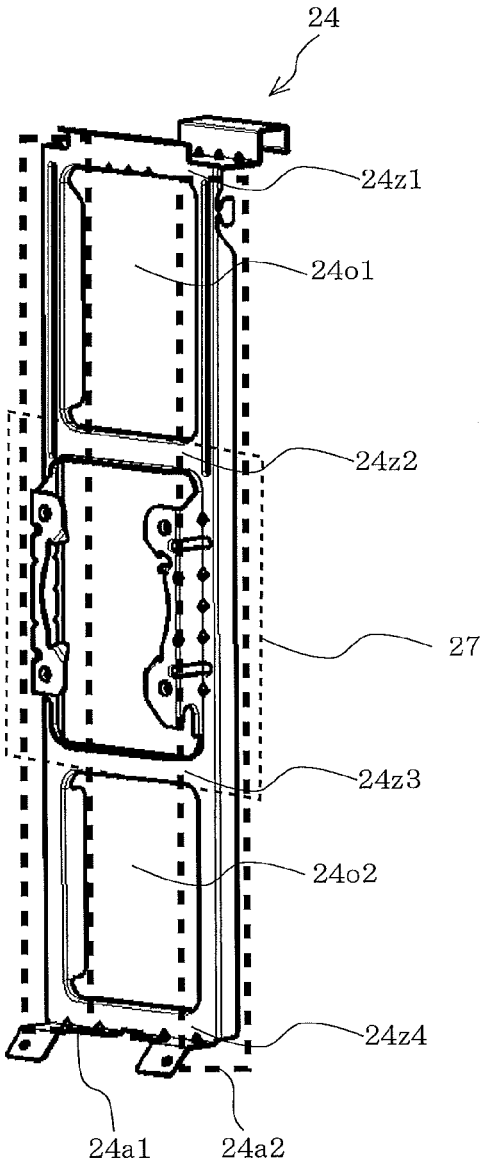
FIG. 3 is a perspective view of a motor fixing support 24 of the outdoor unit 100 for an air-conditioning apparatus according to Embodiment 1 of the present invention.
Figure 4:
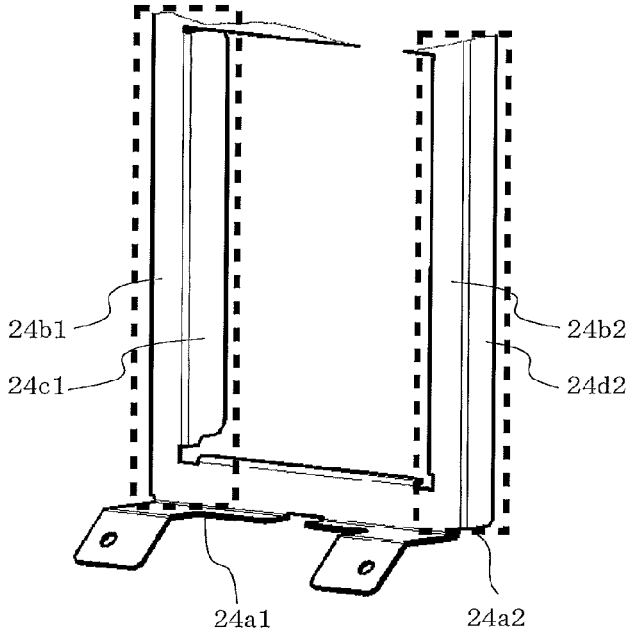
FIG. 4 is a detailed perspective view of FIG. 3, for illustrating a lower part of the motor fixing support 24 of the outdoor unit 100 for an air-conditioning apparatus according to Embodiment 1 of the present invention.

FIG. 1 is a front view of the outdoor unit 100 for an air-conditioning apparatus according to Embodiment 1 of the present invention. FIG. 2 is an exploded perspective view of the outdoor unit 100 for an air-conditioning apparatus according to Embodiment 1 of the present invention. FIG. 3 is a perspective view of a motor fixing support 24 of the outdoor unit 100 for an air-conditioning apparatus according to Embodiment 1 of the present invention. FIG. 4 is a detailed perspective view of FIG. 3, for illustrating a lower part of the motor fixing support 24 of the outdoor unit 100 for an air-conditioning apparatus according to Embodiment 1 of the present invention.

As illustrated in FIG. 1, an outer shell of the outdoor unit 100 is constructed by a housing 50. As illustrated in FIG. 2, the housing 50 includes a front panel 50*a*, a right panel 50*b*, a bottom panel 50*c*, a top panel 50*d*, and a rear panel (not shown). The front panel 50*a* constructs a front surface side and a left surface side of the housing 50, and is formed by, for example, a member having an L-shape in plan view. Further, as illustrated in FIG. 2, a partition plate 1 is arranged in an inside of the housing 50. The partition plate 1 partitions the inside of the housing 50 into a machine chamber 10 and a blowing device chamber 20.

Note that, a part of the front panel 50*a* constructing the front surface part of the housing 50 and a part of the front panel 50*a* constructing the left surface part of the housing 50 may be formed as separate members. That is, the front panel 50*a* may be divided into a front panel constructing the front surface part of the housing 50 and a left panel constructing the left surface part of the housing 50.

The machine chamber 10 includes a compressor 11, an electrical component box 12, and a refrigerant pipe 13 arranged therein. A control board (not shown) is arranged in an inside of the electrical component box 12. The control board (not shown) is, for example, a member for controlling the number of revolutions of the compressor 11. Note that, the control board (not shown) is constructed by, for example, hardware for implementing this function, such as a circuit device, or software to be executed by a processor such as a microcomputer and a CPU.

The blowing device chamber 20 includes an outdoor heat exchanger 21, a fan 22, a motor 23, the motor fixing support 24, an upper plate 25, and a support plate-connecting section 26 arranged therein. The outdoor heat exchanger 21 is arranged on a rear surface side of the outdoor unit 100 with respect to the fan 22, the motor 23, the motor fixing support 24, an upper plate 25, and the support plate-connecting section 26.

The outdoor heat exchanger 21 has, for example, an L-shape in plan view, and is arranged along a surface of the left surface side of the front panel 50*a* and the rear panel (not shown). The fan 22 is blowing means such as a propeller fan, for generating air circulation so as to exchange heat efficiently. The fan 22 has a function of introducing outdoor air from the rear surface side of the outdoor unit 100 to an inside of the outdoor unit 100 and discharging the outdoor air, which is introduced to the inside of the outdoor unit 100, toward the front surface side of the outdoor unit 100.

The motor 23 is driving means for driving the fan 22, and is, for example, mounted on the motor fixing support 24 with fixing means such as a screw. The motor fixing support 24 is arranged so as to support the motor 23, and is a frame-shaped member extending upward from the bottom panel 50*c*. Note that, details of the motor fixing support 24 are described later.

The upper plate 25 is, for example, a plate-shaped member arranged substantially horizontally to the bottom panel 50*c*. The upper plate 25 is a member for reinforcing the strength of the motor fixing support 24 in consideration of a case where the motor 23 is increased in size. The upper plate 25 is connected to the motor fixing support 24. The upper plate 25 is mounted, for example, so as to extend from an uppermost end of the motor fixing support 24 toward a front side of the housing 50.

The support plate-connecting section 26 is, for example, a U-shaped member, and is, for example, formed integrally with the motor fixing support 24. The support plate-connecting section 26 is arranged so that an inner surface thereof is held in contact with an upper surface of the outdoor heat exchanger 21. As described above, the support plate-connecting section 26 is mounted on the outdoor heat exchanger 21, and thus the motor fixing support 24 is fixed to the outdoor heat exchanger 21.

As illustrated in FIG. 3, the motor fixing support 24 is a member including supporting sections 24*a*1 and 24*a*2 and connecting sections 24*z*1, 24*z*2, 24*z*3, and 24*z*4. The motor fixing support 24 is, for example, formed by sheet metal press integral forming. The motor fixing support 24 extends in a vertical direction of the housing 50 under a state of being arranged in the housing 50. The motor 23 is mounted on the motor fixing support 24 with the fixing means such as the screw (not shown). Hollow portions 24*o*1 and 24*o*2 are formed in the motor fixing support 24. An enlarged view of a lower part of FIG. 3 is, for example, as illustrated in FIG. 4. In the following description, the supporting sections 24*a*1 and 24*a*2 may be collectively referred to as "supporting section 24*a*".

The supporting sections 24*a*1 and 24*a*2 are parts extending in the vertical direction, which are respectively formed on both sides of the motor fixing support 24 in a lateral direction thereof. The connecting sections 24*z*1, 24*z*2, 24*z*3, and 24*z*4 are parts connecting the supporting section 24*a*1 and the supporting section 24*a*2 to each other. In an order from the top of the motor fixing support 24, the connecting sections 24*z*1, 24*z*2, 24*z*3, and 24*z*4 are formed.

The hollow portions 24*o*1 and 24*o*2 are opening portions for causing a part of a flow of air, which is blown onto the motor fixing support 24, to pass therethrough. The hollow portion 24*o*1 is formed between the connecting section 24*z*1 and the connecting section 24*z*2. The hollow portion 24*o*2 is formed between the connecting section 24*z*3 and the connecting section 24*z*4. With the hollow portions 24*o*1 and 24*o*2 formed as described above, a flow of the outdoor air, which flows into the inside of the housing 50, can be prevented from being obstructed.

Figure 5:
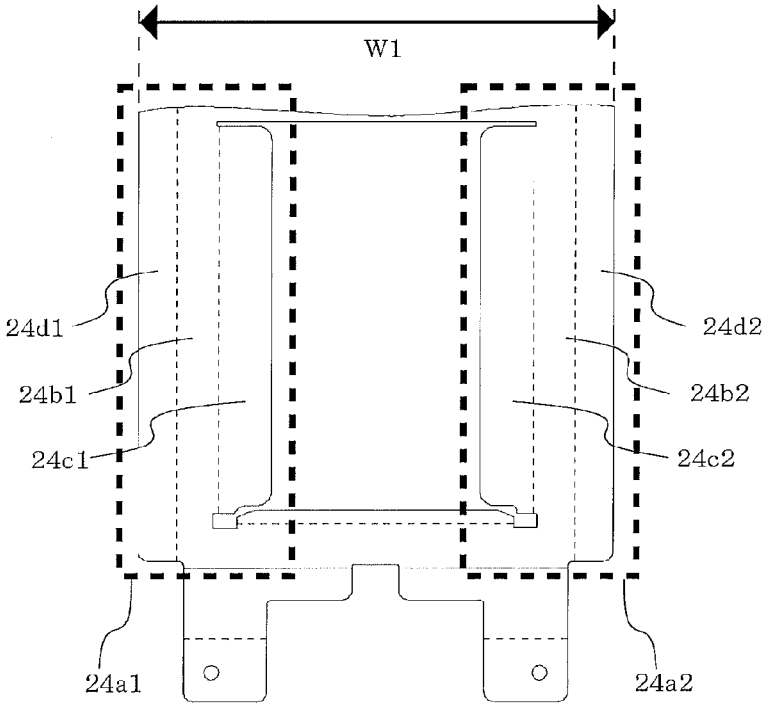
FIG. 5 is a developed view of the motor fixing support 24 of the outdoor unit 100 for an air-conditioning apparatus according to Embodiment 1 of the present invention.

FIG. 5 is a developed view of the motor fixing support 24 of the outdoor unit 100 for an air-conditioning apparatus according to Embodiment 1 of the present invention. The dotted boxes of FIG. 5 respectively denote parts of the supporting sections 24*a*1 and 24*a*2. As illustrated in FIG. 5, the supporting section 24*a*1 includes a base section 24*b*1 and folding pieces 24*c*1 and 24*d*1. Further, the supporting section 24*a*2 includes a base section 24*b*2 and folding pieces 24*c*2 and 24*d*2. Note that, W1 of FIG. 5 indicates a material width of the motor fixing support 24.

The base section 24*b*1 is a long part extending in the vertical direction, which is formed on one side of the motor fixing support 24 in the lateral direction. The folding pieces 24*c*1 and 24*d*1 are parts respectively extending from both side edges of the base section 24*b*1 in a short-side direction. The base section 24*b*2 is a part extending in the vertical direction, which is formed on the other side of the motor fixing support 24 in the lateral direction. The folding pieces 24*c*2 and 24*d*2 are parts respectively extending from both side edges of the base section 24*b*2 in the short-side direction.

Lengths of the folding pieces 24*c*1 and 24*c*2 in an extending direction are larger than lengths of the folding pieces 24*d*1 and 24*d*2 in the extending direction. That is, the length of the folding piece 24*c*1 in the extending direction, which extends from the base section 24*b*1 toward the base section 24*b*2 in the short-side direction, and the length of the folding piece 24*c*2 in the extending direction, which extends from the base section 24*b*2 toward the base section 24*b*1 in the short-side direction, are larger than the lengths of the folding pieces 24*d*1 and 24*d*2 in the extending direction. Note that, the lengths of the folding pieces 24*c*1 and 24*c*2 in the extending direction are, for example, the same lengths. Further, the lengths of the folding pieces 24*d*1 and 24*d*2 in the extending direction are, for example, the same lengths.

Figure 6:
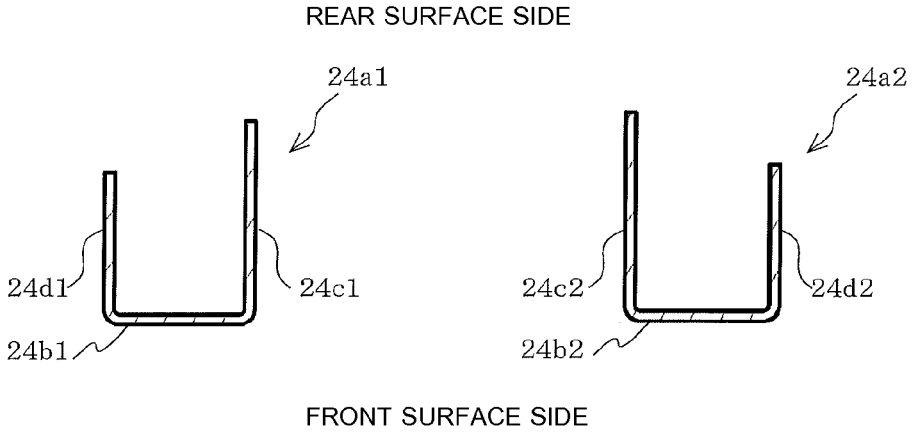
FIG. 6 is an enlarged view for illustrating a first example of an upper cross section of a supporting section 24*a* of the outdoor unit 100 for an air-conditioning apparatus according to Embodiment 1 of the present invention.
Figure 7:
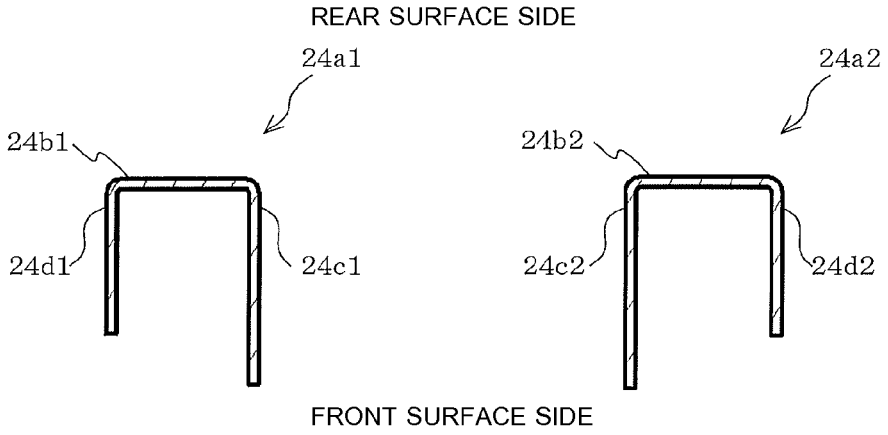
FIG. 7 is an enlarged view for illustrating a second example of the upper cross section of the supporting section 24*a* of the outdoor unit 100 for an air-conditioning apparatus according to Embodiment 1 of the present invention.
Figure 8:
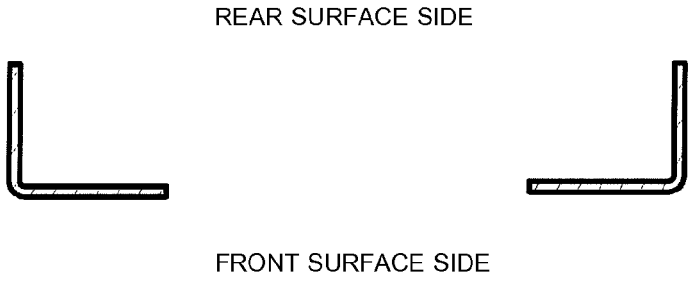
FIG. 8 is an enlarged reference view for illustrating the upper cross section of the supporting section.
Figure 9:
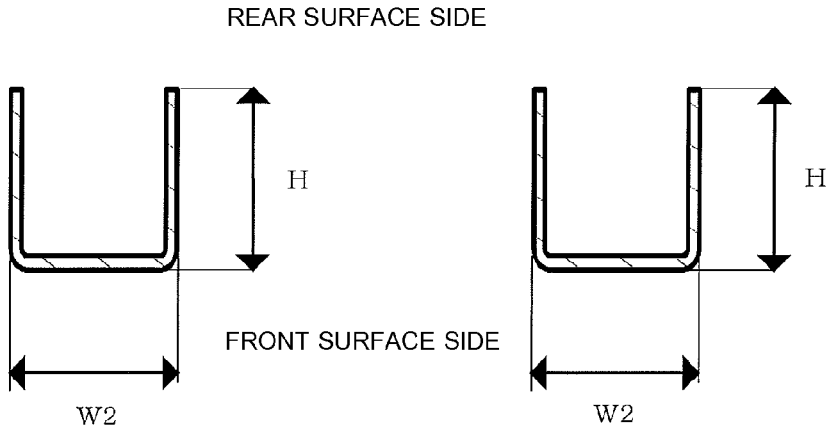
FIG. 9 is an enlarged reference view for illustrating the upper cross section of the supporting section.

FIG. 6 is an enlarged view for illustrating a first example of an upper cross section of the supporting section 24*a* of the outdoor unit 100 for an air-conditioning apparatus according to Embodiment 1 of the present invention. FIG. 7 is an enlarged view for illustrating a second example of the upper cross section of the supporting section 24*a* of the outdoor unit 100 for an air-conditioning apparatus according to Embodiment 1 of the present invention. FIG. 8 is an enlarged reference view for illustrating the upper cross section of the supporting section. FIG. 9 is an enlarged reference view for illustrating the upper cross section of the supporting section.

As illustrated in FIG. 6, the supporting section 24*a* has a substantially U-shape in horizontal section. The folding pieces 24*c*1, 24*c*2, 24*d*1, and 24*d*2 illustrated in FIG. 6 are formed by folding the folding pieces 24*c*1, 24*c*2, 24*d*1, and 24*d*2 illustrated in FIG. 5 toward the rear surface side of the housing 50. The description "toward the rear surface side of the housing 50" as used herein indicates a direction from a downstream side toward an upstream side in a flow direction of the air in the inside of the housing 50.

As described above, the lengths of the folding pieces 24*c*1 and 24*c*2 in the extending direction are larger than the lengths of the folding pieces 24*d*1 and 24*d*2 in the extending direction. Therefore, under a state in which the folding pieces 24*c*1, 24*c*2, 24*d*1, and 24*d*2 are folded toward the rear surface side of the housing 50, end portions of the folding pieces 24*c*1 and 24*c*2 on the rear surface side of the housing 50 are positioned rearward with respect to end portions of the folding pieces 24*d*1 and 24*d*2 on the rear surface side of the housing 50.

Note that, the folding direction of the folding pieces 24*c*1, 24*c*2, 24*d*1, and 24*d*2 is not limited to the direction toward the rear surface side of the housing 50 as in FIG. 6. For example, as illustrated in FIG. 7, the folding pieces 24*c*1, 24*c*2, 24*d*1, and 24*d*2 may be folded toward the front surface side of the housing 50. In this case, the end portions of the folding pieces 24*c*1 and 24*c*2 on the front surface side of the housing 50 are positioned forward with respect to the end portions of the folding pieces 24*d*1 and 24*d*2 on the front surface side of the housing 50. The description "toward the front surface side of the housing 50" as used herein indicates a direction from the upstream side toward the downstream side in the flow direction of the air in the inside of the housing 50.

When the folding pieces 24*c*1, 24*c*2, 24*d*1, and 24*d*2 are folded toward the rear surface side of the housing 50 as in FIG. 6, a required strength as the motor fixing support 24 is ensured. Further, when the motor 23 is to be fixed in the case where the folding pieces 24*c*1, 24*c*2, 24*d*1, and 24*d*2 are folded in the rear surface direction of the housing 50, there is no fear that a hand of an assembly worker may touch end surfaces of the folding pieces 24*c*1, 24*c*2, 24*d*1, and 24*d*2, with the result that assembly safety and workability are improved.

When the folding pieces 24*c*1, 24*c*2, 24*d*1, and 24*d*2 are folded toward the front surface side of the housing 50 as in FIG. 7, a required strength as the motor fixing support 24 is ensured. Further, in the case where the folding pieces 24*c*1, 24*c*2, 24*d*1, and 24*d*2 are folded in the front surface direction of the housing 50, in the process of causing the air, which flows from the rear surface side into the front surface side of the outdoor heat exchanger 21, to flow out in the front surface direction of the housing 50, noise due to turbulence of the air can be reduced without the turbulence of the air. Further, the air does not stagnate in any portion, with the result that the heat exchange efficiency can be improved.

Considering rigidity of the supporting section 24*a*, under a condition that a plate thickness, a material, and a length (height of the supporting section 24*a*) are the same in the supporting section 24*a*, the same rigidity can be obtained by setting equivalent a moment of inertia of area of the supporting section 24*a*. Note that, when the folding piece is formed on only one side of the supporting section 24*a* so as to obtain an L-shaped cross section as illustrated in FIG. 8, sufficient rigidity cannot be obtained. Therefore, as illustrated in FIG. 9, in general, the lengths of the folding pieces 24*c*1, 24*c*2, 24*d*1, and 24*d*2 in the extending direction are set equal to each other so as to ensure the rigidity. Under a condition that a support column width W2 illustrated in FIG. 9 is the same and the plate thickness and the material are the same, as heights H of the folding pieces 24*c*1, 24*c*2, 24*d*1, and 24*d*2 are increased, the moment of inertia of area is increased, with the result that the rigidity is increased. Focusing on the above-mentioned matter, as illustrated in FIGS. 6 and 7, even when the heights of the folding pieces 24*c*1 and 24*c*2 are increased (lengths are increased) and the heights of the folding pieces 24*d*1 and 24*d*2 are reduced (lengths are reduced), the moment of inertia of area is equivalent, that is, a cross-sectional shape having uniform rigidity can be obtained.

As described above, the motor fixing support 24 of the outdoor unit 100 for an air-conditioning apparatus according to Embodiment 1 includes the long base sections 24*b*1 and 24*b*2 extending in the vertical direction, which are respectively formed on both the sides in the lateral direction, and the folding pieces 24*c*1, 24*c*2, 24*d*1, and 24*d*2 respectively extending from both the side edges of the respective base sections 24*b*1 and 24*b*2 in the short-side direction. The length of the folding piece 24*c*1 in the extending direction, which extends from the base section 24*b*1 toward the base section 24*b*2 in the short-side direction, and the length of the folding piece 24*c*2 in the extending direction, which extends from the base section 24*b*2 toward the base section 24*b*1 in the short-side direction, are larger than the lengths of the folding pieces 24*d*1 and 24*d*2 in the extending direction.

under a folded state, the folding pieces 24*c*1, 24*c*2, 24*d*1, and 24*d*2, which respectively extend from both the side edges of the respective base sections 24*b*1 and 24*b*2 in the short-side direction, extend toward the front surface side of the housing 50 or the rear surface side of the housing 50. As described above, the folding pieces 24*c*1, 24*c*2, 24*d*1, and 24*d*2 for reinforcing the strength of the motor fixing support 24 are each formed as one element of the motor fixing support 24, and hence a usage amount of materials can be reduced and the strength of the motor fixing support 24 can be reinforced without increasing the number of components.

Further, when the lengths of the folding pieces 24*d*1 and 24*d*2 in the extending direction are reduced (shortened), the material width W1 can be reduced by the reduced amount of the lengths. Therefore, the usage amount of materials can be reduced. That is, when the lengths of the folding pieces 24*c*1 and 24*c*2 in the extending direction are set larger than the lengths of the folding pieces 24*d*1 and 24*d*2 in the extending direction, the same rigidity as in the case where the heights of the folding piece 24*c*1 and the folding piece 24*d*1 are set equal to each other can be ensured, and the usage amount of materials can be reduced, thereby being capable of contributing to resource saving.

Note that, the folding pieces 24*c*1, 24*c*2, 24*d*1, and 24*d*2 only need to be formed at least below a motor holding section 27. The description "motor holding section 27" as used herein indicates, for example, a region member provided between the hollow portion 24*o*1 and the hollow portion 24*o*2. The description "below a motor holding section 27" indicates, for example, a region below an opening edge formed above the hollow portion 24*o*2. With the folding pieces 24*c*1, 24*c*2, 24*d*1, and 24*d*2 formed as described above, deformation of the motor fixing support 24 due to weight of the fan 22 and the motor 23 during transportation of the outdoor unit 100 can be prevented.

Embodiment 2

Shapes of the folding pieces 24*c*1, 24*c*2, 24*d*1, and 24*d*2 according to Embodiment 2 are different from those in Embodiment 1. Note that, in Embodiment 2, the items are assumed to be the same as those in Embodiment 1 unless otherwise stated, and the same functions and components are denoted by the same reference symbols for description.

Figure 10:
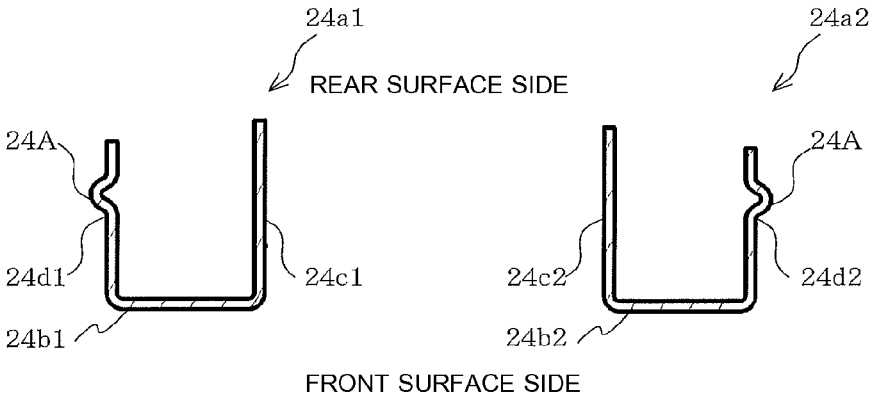
FIG. 10 is a view of an upper cross section of a motor fixing support 24 of an outdoor unit 100 for an air-conditioning apparatus according to Embodiment 2 of the present invention.

FIG. 10 is a view of an upper cross section of a motor fixing support 24 of an outdoor unit 100 for an air-conditioning apparatus according to Embodiment 2 of the present invention. As illustrated in FIG. 10, a bulging portion 24A is formed on each of the folding pieces 24*d*1 and 24*d*2. In Embodiment 2, as in Embodiment 1, the folding pieces 24*c*1, 24*c*2, 24*d*1, and 24*d*2 are folded so as to reinforce the motor fixing support 24. Further, as illustrated in FIG. 10, the bulging portion 24A is formed on the folding piece through press forming. In this manner, the moment of inertia of area is increased, with the result that the strength can be further reinforced.

As described above, in the outdoor unit 100 for an air-conditioning apparatus according to Embodiment 2, the bulging portion 24A is formed on each of the folding pieces 24*d*1 and 24*d*2. Therefore, the heights of the folding pieces 24*d*1 and 24*d*2 can be reduced, with the result that the usage amount of materials can be reduced.

Note that, the example in which the bulging portion 24A is formed only on each of the folding pieces 24*d*1 and 24*d*2 is described, but the bulging portion 24A is not limited to the example. The bulging portion 24A only needs to be formed on at least one of the folding pieces 24*c*1, 24*c*2, 24*d*1, and 24*d*2. Note that, when the bulging portion 24A is formed on all of the folding pieces 24*c*1, 24*c*2, 24*d*1, and 24*d*2, the strength of the motor fixing support 24 can be further reinforced.

REFERENCE SIGNS LIST

1 partition plate 10 machine chamber 11 compressor 12 electrical component box 13 refrigerant pipe 20 blowing device chamber 21 outdoor heat exchanger 22 fan 23 motor 24 motor fixing support 24A bulging portion 24*a*, 24*a*1, 24*a*2 supporting section 24*b*1, 24*b*2 base section

24*c*1, 24*c*2, 24*d*1, 24*d*2 folding piece 24*o*1, 24*o*2 hollow portion

24*z*1, 24*z*2, 24*z*3, 24*z*4 connecting section 25 upper plate 26 support plate-connecting section 27 motor holding section 50 housing 50*a* front panel

50*b* right panel 50*c* bottom panel 50*d* top panel 100 outdoor unit H height W1 material width W2 support column width

The invention claimed is:

1. An outdoor unit for an air-conditioning apparatus, comprising:

a housing;

an outdoor heat exchanger arranged inside the housing;

a fan arranged on a front surface of the outdoor heat exchanger;

a motor configured to drive the fan; and a motor fixing support configured to fix the motor, the motor fixing support including:

long base sections extending in a vertical direction and respectively formed on both sides of the motor fixing support in a lateral direction;

folding pieces respectively extending from both side edges of each of the base sections in a short-side direction; and a motor holding section configured to hold the motor, one of the folding pieces extending from one of the base sections toward an other of the base sections, an other of the folding pieces extending from the other of the base sections toward the one of the base sections, the one and the other of the folding pieces having lengths in respective extending directions larger than a length in an extending direction of still other at least one of the folding pieces, wherein the folding pieces respectively extending from both the side edges of the each of the base sections in the short-side direction are formed below the motor holding section, and extend toward a front surface side of the housing or a rear surface side of the housing under a folded state.

2. The outdoor unit for an air-conditioning apparatus of claim 1, further comprising a connecting section for connecting the one of the base sections and the other of the base sections to each other.

3. The outdoor unit for an air-conditioning apparatus of claim 1, wherein at least one of the folding pieces, which respectively extend from both the side edges of the each of the base sections in the short-side direction, comprises a bulging portion.

4. The outdoor unit for an air-conditioning apparatus of claim 1, wherein the motor fixing support is formed by sheet metal press integral forming.

5. The outdoor unit for an air-conditioning apparatus of claim 1, wherein the motor holding section extends from one or more of the long base sections.

6. The outdoor unit for an air-conditioning apparatus of claim 1, wherein the motor holding section comprises:

a first motor holding piece extending from a first long base section chosen from the long base sections; and a second motor holding piece extending from a second long base section chosen from the long base sections, the second long base section being different from the first long base section, wherein the first and second motor holding pieces are different from the folding pieces.

7. The outdoor unit for an air-conditioning apparatus of claim 1, wherein the motor holding section extends from the long base sections in a direction facing the motor, and the motor holding section is separate from the folding pieces.

8. The outdoor unit for an air-conditioning apparatus of claim 1, wherein the folding pieces extend from the long base sections in a direction facing away from the motor, and the motor holding section extends from the long base sections in a direction facing the motor.

9. The outdoor unit for an air-conditioning apparatus of claim 3, wherein the bulging portion is a concavity on a side of the at least one of the folding pieces.

* * * * *